US007923651B2

(12) United States Patent
Suzuki et al.

(10) Patent No.: US 7,923,651 B2
(45) Date of Patent: Apr. 12, 2011

(54) SILVER-COATED STAINLESS STEEL STRIP FOR MOVABLE CONTACTS AND METHOD OF PRODUCING THE SAME

(75) Inventors: Satoshi Suzuki, Tokyo (JP); Kuniteru Mihara, Tokyo (JP); Naofumi Tokuhara, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 12/748,587

(22) Filed: Mar. 29, 2010

(65) Prior Publication Data

US 2010/0187084 A1 Jul. 29, 2010

Related U.S. Application Data

(60) Division of application No. 11/413,041, filed on Apr. 28, 2006, now abandoned, which is a continuation of application No. PCT/JP2004/016182, filed on Oct. 25, 2004.

(30) Foreign Application Priority Data

Oct. 31, 2003 (JP) ..... 2003-372008

(51) Int. Cl.
*H01H 1/023* (2006.01)

(52) U.S. Cl. ..... 200/269; 428/673; 428/685; 428/929

(58) Field of Classification Search ..... None
See application file for complete search history.

(56) References Cited

U.S. PATENT DOCUMENTS

| | | | |
|---|---|---|---|
| 2,878,172 | A | 3/1959 | Scavullo |
| 4,055,062 | A | 10/1977 | Martin et al. |
| 4,488,356 | A | 12/1984 | Gust et al. |
| 4,508,396 | A | 4/1985 | Doi et al. |
| 4,604,169 | A | 8/1986 | Shiga et al. |
| 4,767,508 | A | 8/1988 | Arakida et al. |
| 5,183,043 | A | 2/1993 | Band et al. |
| 5,737,043 | A | 4/1998 | Takaya |
| 6,930,266 | B2 | 8/2005 | Takeuchi et al. |

FOREIGN PATENT DOCUMENTS

| | | | |
|---|---|---|---|
| JP | 50-3502 | B | 2/1975 |
| JP | 51-27853 | A | 8/1976 |
| JP | 55-018574 | A | 2/1980 |
| JP | 52-219945 | A | 12/1984 |

(Continued)

OTHER PUBLICATIONS

Lowenheim, Frederic A., Modern Electroplating, The Electrochemistry Society, Inc., 1942, pp. 158-162.

(Continued)

*Primary Examiner* — John J Zimmerman
(74) *Attorney, Agent, or Firm* — Westerman, Hattori, Daniels & Adrian, LLP

(57) ABSTRACT

An electrical contact comprising a silver-coated stainless steel strip, which has an underlying layer comprising any one of nickel, cobalt, nickel alloys, and cobalt alloys, on at least a part of the surface of a stainless steel substrate, and has a silver or silver alloy layer formed as an upper layer, in which a copper or copper alloy layer with a thickness of 0.05 to 2.0 μm is provided between the silver or silver alloy layer and the underlying layer; and a producing method of the above-described electrical contact, in which the silver-coated stainless steel strip is subjected to a heat-treating in a non-oxidative atmosphere.

4 Claims, 2 Drawing Sheets

FOREIGN PATENT DOCUMENTS

| | | | |
|---|---|---|---|
| JP | 59-219945 | A | 12/1984 |
| JP | 60-131996 | A | 7/1985 |
| JP | 63-137193 | A | 6/1988 |
| JP | 06-334087 | A | 12/1994 |
| JP | 11-232950 | A | 8/1999 |
| JP | 2002-334628 | A | 11/2002 |
| JP | 2003-203534 | A | 7/2003 |
| JP | 2003-272466 | A | 9/2003 |
| JP | 2004-263274 | A | 9/2004 |
| JP | 2005-002400 | A | 1/2005 |

OTHER PUBLICATIONS

English Translation of JP 2004-263274, Sep. 24, 2004.

Chinese Office Action dated Oct. 9, 2009 issued in corresponding Chinese patent Application No. 2004800383323.

SILVER-COATED STAINLESS STEEL STRIP FOR MOVABLE CONTACTS AND METHOD OF PRODUCING THE SAME

CROSS-REFERENCE TO RELATED APPLICATION

This application is a divisional application of Ser. No. 11/413,041, filed Apr. 28, 2006, now abandoned, which a continuation of PCT/JP2004/016182, filed Oct. 25, 2004, which is based upon and claims the benefit of priority from Japanese Patent Application No. 2003-372008, filed Oct. 31, 2003, the entire contents of which being incorporated herein by reference.

TECHNICAL FIELD

The present invention relates to electrical contacts having a long operable life, more particularly to a silver-coated stainless steel strip having a long life when used as movable contacts.

BACKGROUND ART

Disk spring contacts, brush contacts, and clip contacts have been mainly used for electric contacts, such as connectors, switches and terminals. Frequently used composite materials for the contacts comprise a relatively inexpensive substrate, such as a copper alloy and stainless steel, having excellent corrosion resistance and mechanical properties, and the substrate is coated with silver, which is excellent in electrical characteristics and solderability.

Among the composite materials for contacts described above, those using stainless steel for the substrate are able to make contacts of small size, since they are superior in mechanical characteristics and fatigue life compared with composite materials for contacts using a copper alloy. Accordingly, they are used for movable contacts, such as a tactile push switch and a sensing switch, that are required to have long life. The materials are frequently used for push buttons for mobile phones in recent years, in which the action frequency of the switches is rapidly increasing due to diversification of mailing functions and Internet functions.

However, while stainless steel coated with silver is able to make a switch small in size while increasing the action frequency, compared with copper alloy coated with silver, there has been a problem that the life is shortened due to wear of the silver, since the pressure at the contacts in the switch is large.

As a stainless steel strip coated with silver or a silver alloy, ones in which a substrate is plated with nickel, are frequently used. However, silver at the contacts is peeled off due to wear with an increased action frequency of the switch, when such a stainless steel strip is used for the switch. As a result, the nickel plating layer of the substrate is exposed to the air, which increases contact resistance, and failures ascribed to mal-continuity become evident. In particular, this phenomenon is liable to occur in dome-shaped movable contacts having a small diameter, which has been a crucial technical problem for further miniaturization of the switch.

To solve the problem, palladium is plated on the nickel plating layer, with additional gold plating thereon. However, electrical resistance increases at the contacts, since palladium is inferior in conductivity.

Therefore, nickel, copper, nickel, and gold are sequentially plated on stainless steel, to improve electrical conductivity. However, cracks appear at the upper layer during bending due to the hardness of nickel plating, to deteriorate corrosion resistance by making the underlying layer expose to the air, although nickel plating itself is excellent in corrosion resistance.

Other and further features and advantages of the invention will appear more fully from the following description, taken in connection with the accompanying drawings.

BRIEF DESCRIPTION OF DRAWINGS

FIG. 2(*a*) typically shows the switch before action, and FIG. 2(*b*) typically shows the switch during the action.

DISCLOSURE OF INVENTION

Figure 1:
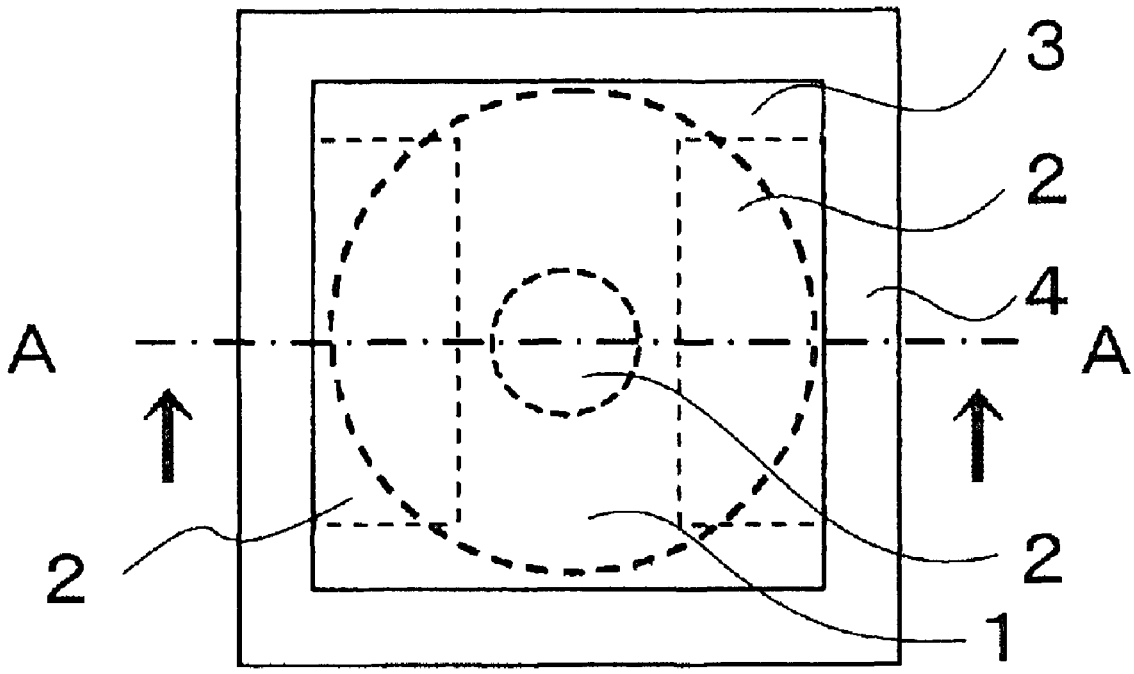
FIG. 1 is a plane view of a switch used for a keystroke test.

According to the present invention, there is provided the following means:

(1) A silver-coated stainless steel strip for movable contacts, which has an underlying layer comprising any one of nickel, cobalt, nickel alloys, and cobalt alloys, on at least a part of the surface of a stainless steel substrate, and has a silver or silver alloy layer formed as an upper layer, wherein a copper or copper alloy layer with a thickness of 0.05 to 2.0 μm is provided between the silver or silver alloy layer and the underlying layer;

(2) The silver-coated stainless steel strip for movable contacts according to the above item (1), wherein a silver-copper alloy layer is formed between the silver or silver alloy layer and the copper or copper alloy layer; and (3) A method of producing a silver-coated stainless steel strip for movable contacts, comprising the steps of: forming an underlying layer comprising any one of nickel, cobalt, nickel alloys, and cobalt alloys, on at least a part of the surface of a stainless steel substrate; forming an interlayer of copper or a copper alloy; coating with silver or a silver alloy; and heat-treating in a non-oxidative atmosphere.

BEST MODE FOR CARRYING OUT THE INVENTION

Through intensive studies for solving the problems in the conventional methods, the inventors have ascertained that the switch is heated with increased continuous action frequency in the case of using conventional silver-coated stainless steel for a tactile push switch, and a shear stress is repeatedly applied to a plating film. Consequently, adhesive force of the silver layer decreases to readily cause peeling and shaving to thereby increase contact resistance by making an oxidized underlying layer expose to the air. The present invention was completed based on the above-mentioned discoveries.

Preferable embodiments of the silver-coated stainless steel strip for movable contacts of the present invention and a method of producing the same will be described in detail hereinafter.

The present invention relates to a material for movable contacts formed by the steps comprising: forming an underlying layer of nickel, cobalt, nickel alloys or cobalt alloys on at least a part of the surface of a stainless steel substrate; and forming an interlayer of copper or a copper alloy, and a silver or silver alloy layer as an upper layer. Contact resistance hardly increases even by increased frequency of action of the switch using the contact material as described above.

Since the stainless steel substrate is responsible for mechanical strength when used for the movable contacts, tension anneal materials and temper rolling materials such as SUS 301, SUS 304 and SUS 316, that are excellent in stress relaxation characteristics and hardly cause fatigue breakage, are generally used as the stainless steel substrate in the present invention.

The underlying layer formed on the stainless steel substrate is disposed in order to enhance adhesiveness between the stainless steel and the copper or copper alloy layer. In addition, the interlayer of copper or a copper alloy is able to enhance adhesiveness between the underlying layer and the silver or silver alloy layer.

The metal for forming the underlying layer is selected from any one of nickel, cobalt, nickel alloys and cobalt alloys, and nickel is preferable. The underlying layer is preferably formed with a plating thickness of 0.05 to 2.0 μm by electrolysis using, for example, an electrolyte solution containing nickel chloride and free hydrochloric acid, and using the stainless substrate as a negative electrode. (Although an example using nickel as the metal for the underlying layer is described hereinafter, the metal is not restricted to nickel, and the same explanation is valid in the case of cobalt, nickel alloys or cobalt alloys.)

Since the cause for decreasing the adhesive force between the conventional silver layer and silver alloy layer is oxidation of the underlying layer and a large shear stress repeatedly applied, it was necessary as countermeasures against it to avoid oxidation of the underlying layer and to develop a material that does not deteriorate its adhesiveness even by applying the shear stress.

An interlayer comprising copper or a copper alloy is disposed in the present invention for avoiding the underlying layer from being oxidized. Oxidation occurs due to permeation of oxygen into the silver layer. When a silver-copper alloy layer is formed by disposing copper or the copper alloy, the silver-copper alloy layer suppresses oxygen from permeating to serve for preventing a decrease of adhesiveness.

Resistivity against the shear stress is improved by a combination for forming a solid solution between adjoining two layers (silver and copper, copper and nickel). Rupture resistant strength against the shear stress was weak between the conventional Ag layer-Ni layer, since the solid concentration of nickel in silver was quite small. The inventors found, through intensive studies, that an alloy of silver and copper is formed at the interface by forming a copper layer between silver and nickel, to improve the strength against shear stress.

In the present invention, while each layer of the underlying layer, copper or copper alloy layer, and silver or silver alloy layer may be formed by any method such as an electroplating method, an electroless plating method, and a chemical/physical deposition method, the electroplating method is most advantageous from the view point of productivity and cost. While each layer described above may be formed on the entire surface of the stainless steel substrate, it is economically advantageous to form the layer only on a part of the contacts.

Further, in order to improve the adhesive strength, when a heat treatment is carried out in a non-oxidative atmosphere, silver is facilitated to diffuse, thereby improving the strength against shear stress. This is because the silver-copper alloy layer is thickened. However, contact stability is rather deteriorated by excessive heat treatment, since all silver in the surface layer is incorporated into the alloy. In addition, when the silver-copper alloy layer is thickened, the conductivity decreases. The thickness of the silver-copper alloy layer is preferably 0.1 μm or less. Although the lower limit is not particularly restricted, it is usually 0.01 μm or more. A preferable heating condition is at 200 to 400° C. for 1 minute to 5 hours.

While hydrogen, helium, argon or nitrogen may be used as the non-oxidative atmosphere gas, argon is preferable.

Contact stability becomes excellent due to the remaining silver on the surface even after heating, by controlling the thickness of the silver or silver alloy-coating layer to be 0.5 to 2.0 μm. It is preferable to add 0.1 to 2.0% by mass of antimony in silver for improving wear resistance, for the silver alloy.

The thickness of the copper or copper alloy layer is preferably 0.05 to 2.0 μm, more preferably in the range of 0.1 to 1.2 μm. While the composition of the copper or copper alloy is not particularly restricted, pure copper, as well as a copper alloy containing 1 to 10% by mass of one or more elements selected from tin, zinc and nickel, is preferable.

Too thin or too thick the copper or copper alloy layer is not preferable, since the effect of providing the layer is hardly exhibited in the former case while action force of the movable contacts of the substrate is decreased in the latter case.

The nickel and cobalt constituting the underlying layer are not particularly restricted. However, in addition to pure nickel, a nickel alloy containing 1 to 10% by mass of cobalt is preferable. When the thickness of the underlying layer of the nickel or nickel alloy is too thin, the effect of the underlying layer is small, while when the thickness is too thick, action force of the movable contacts of the substrate decreases.

In the present invention, the size of the silver-coated stainless strip is different depending on its use and is not particularly restricted. For example, the strip may be a continuous strip with a strip thickness of 0.03 mm to 0.20 mm, and a strip width of 3 mm to 50 mm. The length of the strip is not particularly restricted, and may be produced by a continuous method, for example.

The silver-coated stainless steel strip of the present invention as movable contacts is excellent in adhesiveness of the plating even by repeatedly applying shear stress, and is improved in life as a switch. Further, the method of the present invention for producing a silver-coated stainless steel strip is favorable for producing the silver-coated stainless steel strip described above.

Examples

The present invention will be described in more detail based on examples given below, but the invention is not meant to be limited by these.

A strip of SUS 301 with a thickness of 0.06 mm and a strip width of 100 mm was subjected to each treatment of electrolytic degreasing, washing with water, electrolytic activation, washing with water, nickel plating (or nickel-cobalt plating), washing with water, copper plating, washing with water, silver strike plating, silver plating, washing with water and drying in a plating line in which the SUS 301 strip was continuously fed followed by winding.

The treatment conditions are shown below.

1. (Electrolytic Degreasing and Electrolytic Activation)

The stainless steel strip was activated by cathode electrolytic degreasing in an aqueous solution of sodium orthosilicate with a concentration of 100 g/l, followed by washing with an aqueous 10% hydrochloric acid.

2. (Nickel Plating)

The activated stainless steel strip was electrolyzed in an electrolytic solution containing 250 g/l of nickel chloride and 50 g/l of free hydrochloric acid at a cathode current density of 5 A/dm$^2$.

3. (Copper Plating)

The nickel-plated stainless steel strip was electrolyzed in an electrolyte solution containing 150 g/l of copper sulfate and 100 g/l of free sulfuric acid at a cathode current density of 5 A/dm$^2$.

4. (Silver Strike Plating)

The copper-plated stainless steel strip was electrolyzed in an electrolyte solution containing 5 g/l of silver cyanate and 50 g/l of potassium cyanate at a cathode current density of 2 A/dm$^2$.

5. (Silver Plating)

The stainless steel strip after silver strike plating was electrolyzed in an electrolyte solution containing 50 g/l of silver cyanate, 50 g/l of potassium cyanate and 30 g/l of potassium carbonate at a cathode current density of 5 A/dm$^2$.

The silver-plated stainless steel strips for the movable contacts shown in Table I were manufactured, while variously changing the thickness of the copper plating layer as the interlayer. The sample in Example 6 was subjected to a heat treatment (250° C.×2 hours in an argon (Ar) gas atmosphere) after completing the drying after the silver plating.

In the conventional example, the copper plating and the subsequent washing with water were omitted in the plating line in which the SUS 301 strip was continuously fed followed by winding.

Figure 2B:
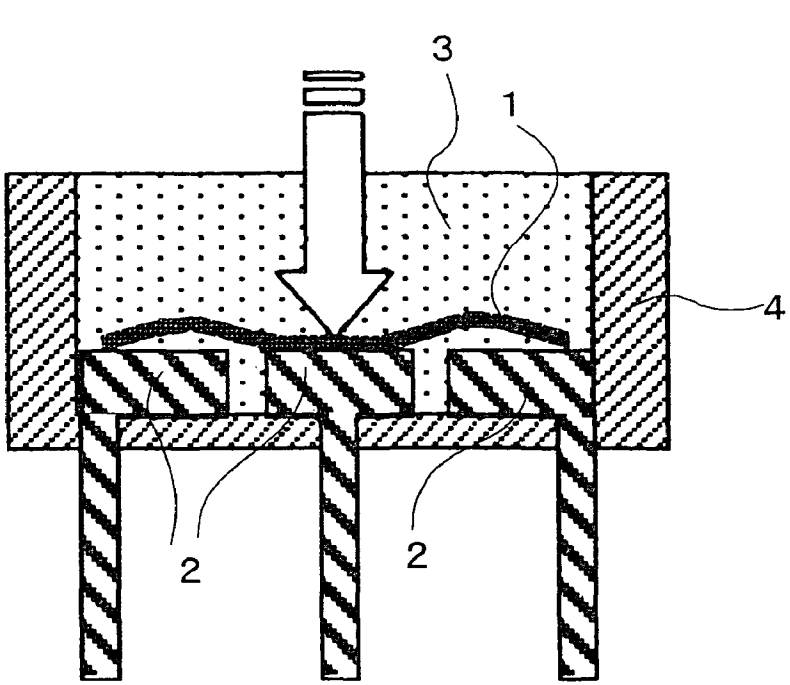
FIG. 2(*a*) and FIG. 2(*b*) show a cross section along the line A-A of the switch used for the keystroke test in FIG. 1 and a compressed state thereof, respectively.
Figure 2A:
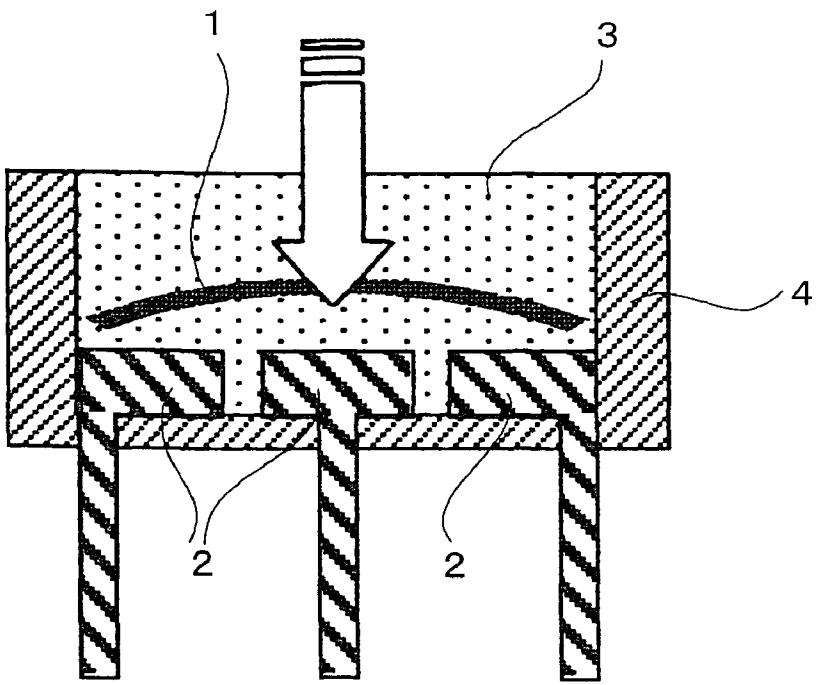

These silver-plated stainless steel strips for the movable contacts obtained were processed into a dome-shape movable contacts of 4 mmϕ in diameter, and the thus-obtained switches having the structure as shown in FIG. 1 and FIGS. 2(*a*) and 2(*b*) were subjected to a keystroke test using a brass strip having a plating layer of silver with a thickness of 1 μm as a fixed contacts. FIG. 1 shows a plane view of the switch used for the keystroke test. FIGS. 2(*a*) and 2(*b*) show a cross sectional drawing of the switch used for the keystroke test along the line A-A in FIG. 1, and pressing pressure thereof. FIG. 2(*a*) shows a drawing before the switch pressing, and FIG. 2(*b*) shows a drawing during the switch pressing. In the Figs., the reference numeral 1 denotes the dome-shape movable contacts made of silver-plated stainless steel; and the reference numeral 2 denotes the fixed contacts of the silver-plated brass. The movable contacts and fixed contacts are integrated into a resin case 4 with a resin filler 3. The arrow outline with a blank inside in the drawings denotes the direction of pressing.

With respect to the keystroke test, the keystrokes were carried out 1,000,000 times at maximum with a contact pressure of 9.8 N/mm$^2$ at a keystroke frequency of 5 Hz, and then the time-dependent change of the contact resistance was measured. The results are shown in Table 1. In addition, the states of the movable contacts were observed after 1,000,000 times of the keystroke test, and the results are also listed in the table.

Only a slight increase of the contact resistance was observed even after 1,000,000 times of the keystroke test in the silver-plated stainless steel strips for the movable contacts of the present invention. Further, the interlayer and the underlying layer were not exposed to the air in the part of the contacts even after 1,000,000 times of keystroke. In addition, no increase of the contact resistance was observed in the sample of Example 6 that was subjected to the heat treatment, even though the thickness of the interlayer was as small as 0.05 μm.

In the comparative example having a thickness of the copper interlayer of 0.01 μm, the contact resistance had started to increase from the point of the keystroke times of 100,000, and reached 250 mΩ at the point of the keystroke times of 1,000,000, although the result was superior to the conventional example. Further, a slight exposure of the underlying layer to the air was observed at the contacts.

In the conventional example having no interlayer, the contact resistance increased from the point of the keystroke times of 100,000 and exceeded 1,000 mΩ at the point of the keystroke times of 1,000,000. The silver at the part of the contacts was peeled off and the underlying layer was exposed to the air.

TABLE 1

| | Construction of coating film at the movable contacts | | | | | | Heat | Result of contact resistance measurements in keystroke test (mΩ) | |
|---|---|---|---|---|---|---|---|---|---|
| | Silver layer | | Interlayer | | Underlying layer | | treatment | | |
| Sample | Kind | .00-ness (μm) | Kind | Thickness (μm) | Kind | Thickness (μm) | 250° C. 2 hr. in Ar | Initial | 10,000 times |
| Example 1 | Silver | 1.0 | Copper | 0.1 | Nickel | 0.3 | Not conducted | 12 | 12 |
| Example 2 | Silver | 1.0 | Copper-5% Tin | 0.5 | Nickel | 0.3 | Not conducted | 10 | 10 |
| Example 3 | Silver-1% Antimony | 1.0 | Copper-5% zinc | 1 | Nickel-10% Cobalt | 0.3 | Not conducted | 9 | 10 |
| Example 4 | Silver | 1.0 | Copper | 2 | Cobalt | 0.3 | Not conducted | 9 | 9 |
| Example 5 | Silver | 1.0 | Copper | 0.05 | Nickel | 0.3 | Not conducted | 12 | 12 |
| Example 6 | Silver | 1.0 | Copper | 0.05 | Nickel | 0.3 | Conducted | 15 | 15 |
| Comparative example | Silver | 1.0 | Copper | 0.01 | Nickel | 0.3 | Not conducted | 12 | 12 |
| Conventional example | Silver | 1.0 | None | — | Nickel | 0.3 | Not conducted | 12 | 12 |

TABLE 1-continued

| Sample | Result of contact resistance measurements in keystroke test (mΩ) | | | | State of the movable contact |
|---|---|---|---|---|---|
| | 50,000 times | 100,000 times | 500,000 times | 1,000,000 times | after 1,000,000 times of keystroke |
| Example 1 | 12 | 15 | 15 | 15 | No exposure of underlying layer |
| Example 2 | 12 | 12 | 10 | 10 | No exposure of underlying layer |
| Example 3 | 10 | 10 | 10 | 11 | No exposure of underlying layer |
| Example 4 | 9 | 10 | 10 | 11 | No exposure of underlying layer |
| Example 5 | 12 | 15 | 20 | 30 | No exposure of underlying layer |
| Example 6 | 15 | 15 | 15 | 15 | No exposure of underlying layer |
| Comparative example | 30 | 80 | 170 | 250 | Slight exposure of underlying layer |
| Conventional example | 30 | 230 | 800 | >1000 | Peeling of silver layer and exposure of underlying layer |

INDUSTRIAL APPLICABILITY

Adhesive force of the silver-coating layer does not decrease after repeatedly applying shear stress in the silver-coated stainless steel strip for the movable contacts of the present invention as compared with the conventional material for the movable contacts. In addition, the silver-coated stainless steel strip of the present invention is excellent in contact stability and conductivity, to enable the movable contacts to have a long life and to be small size.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. An electrical contact having a metallic contact surface, wherein the electrical contact comprises:

a stainless steel substrate;

an underlying layer comprising at least one selected from the group consisting of nickel, cobalt, nickel alloys, and cobalt alloys, said underlying layer being provided on at least a part of the stainless steel substrate;

an interlayer of copper or a copper alloy, said interlayer having a thickness of 0.05 to 2.0 μm and being provided on the underlying layer; and an upper layer of silver or a silver alloy, said upper layer being provided on the interlayer and being positioned at the metallic contact surface of said electrical contact;

wherein said electrical contact is located adjacent to at least two electrical terminals, and said contact is movable between a closed position in which said contact closes an electrical circuit between the terminals and an opened position in which said contact opens said electrical circuit between the terminals, and wherein a majority of stress applied on said electrical contact when moving between the opened position and the closed position is in a direction perpendicular parallel to the thickness directions of said layers.

2. The electrical contact according to claim 1, wherein said electrical contact is dome-shaped tactile electrical contact.

3. The electrical contact according to claim 2, wherein said electrical contact has a diameter of 4 mm or less.

4. The electrical contact according to claim 2, wherein said electrical contact is tactile push switch.

* * * * *